US007575397B2

(12) United States Patent
Sharapov

(10) Patent No.: US 7,575,397 B2
(45) Date of Patent: Aug. 18, 2009

(54) FLOATING PLATFORM WITH NON-UNIFORMLY DISTRIBUTED LOAD AND METHOD OF CONSTRUCTION THEREOF

(76) Inventor: Sergey Sharapov, 18 Dorado Ter. #7, San Francisco, CA (US) 94112

( * ) Notice: Subject to any disclaimer, the term of this patent is extended or adjusted under 35 U.S.C. 154(b) by 369 days.

(21) Appl. No.: 11/504,300

(22) Filed: Aug. 14, 2006

(65) Prior Publication Data

US 2008/0038067 A1 Feb. 14, 2008

(51) Int. Cl.
*B63B 35/00* (2006.01)

(52) U.S. Cl. ..... 405/224; 405/223.1; 114/264

(58) Field of Classification Search ..... 405/195.1, 405/200, 203, 204, 205, 206, 219, 223.1, 405/224; 114/264–266
See application file for complete search history.

(56) References Cited

U.S. PATENT DOCUMENTS 1,900,319 A * 3/1933 Vermeulen ..... 405/218
3,665,882 A * 5/1972 Georgiev et al. ..... 114/266
3,785,313 A * 1/1974 Rosenberg ..... 114/266
3,788,254 A * 1/1974 Sheil ..... 114/266
3,949,693 A 4/1976 Bauer
4,067,285 A * 1/1978 Jones et al. ..... 114/266
4,498,412 A 2/1985 Liden
4,801,220 A * 1/1989 Bores ..... 405/31
5,251,560 A * 10/1993 Ban et al. ..... 114/266
5,375,550 A * 12/1994 Innis ..... 114/267
5,529,013 A * 6/1996 Eva et al. ..... 114/266
5,588,387 A 12/1996 Tellington
5,997,218 A 12/1999 Boerseth
6,037,031 A * 3/2000 Jones et al. ..... 114/266
6,213,045 B1 4/2001 Gaber
6,540,441 B1 4/2003 Foss et al.
6,718,901 B1 4/2004 Abbot et al.
6,817,309 B2 * 11/2004 Horton ..... 114/264
6,945,737 B1 9/2005 Xu

FOREIGN PATENT DOCUMENTS

GB 2311319 9/1997

* cited by examiner

*Primary Examiner*—Frederick L Lagman

(57) ABSTRACT

The floating platform of the invention is intended for supporting industrial, commercial, cultural, and dwelling structures and is suitable for deployment in shallow as well as in deep waters, The platform is assembled from prefabricated hollow structural elements in such a way that the unified center of masses of the loads that consist of a plurality of arbitrarily distributed loads of different masses supported by the platform is always maintained in the same position whereby the platform is always maintained in a horizontally counterbalanced position. This is achieved by locally adjusting the buoyancy of the structural elements. Furthermore, the loads are positioned on the platform so that moments created by these loads relative to the aforementioned unified center of masses are equal. This allows maintaining the loads on the platform in equilibrium.

8 Claims, 6 Drawing Sheets

FLOATING PLATFORM WITH NON-UNIFORMLY DISTRIBUTED LOAD AND METHOD OF CONSTRUCTION THEREOF

FIELD OF THE INVENTION

The invention relates to floating structures, in particular, to offshore structures with non-uniform distribution of load, such as floating islands that may support oil and gas recovery equipment, airports, industrial installations, buildings, dwelling houses, stores, and other facilities required for industrial activity and urban life.

Various floating offshore structures are well known since long ago and find use in development of deep-water oil and gas fields, such as are found in the Gulf of Mexico and the North Sea. However, in addition to offshore recovery of natural resources, recently new trends appeared in the field of development of floating structures. These new trends are associated with the risk of increase in the level of the world ocean in connection with melting of Arctic an Antarctic ice packs because of global warming.

Although the floating offshore structure of the invention relates to a floating platform with industrial and dwelling facilities and covers a surface area much greater that that of a floating platform used for supporting oil and gas drilling equipment, structurally the floating platforms of the invention is very similar to the floating structures that support drilling equipment. Therefore, for understanding the principle of the present invention, it would be advantageous to review the structure of offshore platforms used in the petroleum and gas-recovery industries.

The development of deep water offshore oil and gas fields present substantial challenges to the petroleum industry. Early production schedule requirements necessitate maximal inshore integration and commissioning, together with a year-round deployment capability. Moreover, the ability to use so-called "dry trees" and steel catenary risers ("SCRs") requires that the motions of the deployed structures in response to wind and waves be relatively small, even in seasons with rough seas.

Such offshore oil and gas operations involve the provision of a vessel or working platform in which the drilling, production and storage equipment, together with the living quarters of the personnel manning the platform, if any, are integrated. In general, offshore platforms fall into one of two groups, i.e., "fixed" and "floating" platforms. Fixed platforms comprise a "topside," or equipment deck, that is supported above the water by legs that extend down to and are seated, directly or indirectly, on the sea floor. While relatively stable, such fixed platforms are typically limited to shallow waters, i.e., depths of about 500 feet (150 m) or less.

Floating platforms are typically employed in water depths of 500 ft. (154 m) and greater, and are held in position over the well site by mooring lines or chains anchored to the sea floor, or by motorized thrusters located on the sides of the platform, or by both. Although floating platforms are more complex to operate because of their greater movement in response to wind and wave conditions, they are capable of operating at substantially greater depths than fixed platforms, and are also more mobile, and hence, easier to move to other offshore well sites. There are several known types of floating platforms, including so-called "drill ships," "tension-leg" platforms ("TLPs"), "spar" platforms ("SPARs"), and "semi-submersible" platforms.

Spar platforms comprise a single, long, slender, buoyant hull that gives the platform the appearance of a column or spar when floating in an upright operating position, in which an upper portion of the platform extends above the waterline and a lower portion is submerged below it. Because of their relatively slender, elongated shape, they provide structural simplicity and compactness, and present a smaller area of resistance to wind and wave forces than do other types of floating platforms. However, the offshore installation of their equipment deck requires the use of a heavy-duty crane barge. Additionally, they have a relatively low hull efficiency, and their off-shore hook-up and connection procedures are relatively time-consuming and expensive. Examples of spar-type floating platforms useful for oil and gas exploration, drilling, production, storage, and gas flaring operations may be found in, e.g., U.S. Pat. No. 6,213,045.

Conventional semi-submersible offshore platforms are used primarily in offshore locations where the water depth exceeds about 300 ft. (91 m). This type of platform comprises a hull structure that has sufficient buoyancy to support the equipment deck above the surface of the water. The hull typically comprises one or more submersible "pontoons" that support a plurality of vertically upstanding columns, which in turn support the deck above the surface of the water. The size of the pontoons and the number of columns are governed by the size and weight of the deck and equipment being supported.

A typical shallow-draft semi-submersible platform has a relatively small draft, typically, about 100 ft. (30.5 m), and incorporates a conventional catenary chain-link spread-mooring arrangement for station-keeping over the well sites. The motions of these types of semi-submersible platforms are relatively large, and accordingly, they require the use of "catenary" risers (either flexible or semi-rigid), extending from the seafloor to the work platform because they are not capable of supporting the other types of risers, e.g., top-tensioned vertical risers ("TTRs") that are typically employed in deep water operations. Also, heavy wellhead equipment must typically be installed on the sea floor, rather than on the work platform, for the same reason. Typical semi-submersible offshore platforms are described in the following references: GB 2,310,634; U.S. Pat. No. 4,498,412, etc.

An "extendable draft" platform, or "EDP," comprises a buoyant equipment deck having a plurality of openings ("leg wells") through the deck. Depending on the application, the deck may be rectangular or triangular, with a leg well at each corner or apex, although other configurations may also be used. A buoyancy column that can be ballasted (e.g., with seawater) is installed in each of the leg wells. The columns are initially deployed in a raised position, and then lowered to a submerged position after the EDP has been moved to a deep water site. Each column is divided by internal bulkheads into a plurality of compartments, and includes means for controllably forcing seawater ballast into and out of selected ones of the compartments to adjust the vertical position of the columns in the water, and hence, the draft of the platform. A "heave plate" or pontoon assembly is attached to the bottom of the columns to help stabilize the EDP against the heave action of wind, waves and swells.

One of the advantages of EDPs is that they are "self-installing," i.e., the hull and topside can be integrated at ground level at the fabrication yard, and no barge crane is required for off-shore deployment. However, they are still subject to increased current motions when compared to, e.g., SPAR platforms, because they typically incorporate from three to nine upright support columns, which extend up through the surface of the water and thereby increase the effective area of resistance of the platform to wind, wave and current forces acting at that level, as compared to a SPAR platform, which exposes only a single, long, slender, buoyant hull to such forces. Additionally, the use of multiple columns entails higher fabrication costs, and the leg wells are relatively wasteful of useful equipment deck area.

It would therefore be desirable if the structural simplicity, compactness and small exposure to wind, wave and current load of a SPAR platform could be combined with the inshore hull and topside integration and self-installing features of a deep draft EDP.

Since the platforms used for supporting oil extraction equipment have a relatively small surface area which is required only for supporting the drilling, production and storage equipment, together with the living quarters of the personnel manning the platform, all these facilities are usually integrated so that normally the platform support a non-distributed load arranged essentially in the center of gravity of the combined platform-and-structure load (see U.S. Pat. No. 6,945,737).

Known also floating platforms with two, parallelly oriented submerged floats that carry columns functioning as additional water displacing floats carrying the platform above the sea level. Sometimes the platforms can be vertically displaced on these columns. These platforms with submerged floating body are easily maneuverable and can readily be transported to their destination point, but the two parallelly disposed displacement elements or bodies react to a significant extent to underwater currents and are difficult to maintain in position. This is particularly so if these platforms are used for offshore drilling. The basic reason for this lack in positional stability must be seen in that the submerged bodies exhibit different characteristics as to stability in longitudinal and transverse directions. Another problem may be associated with a variable load distribution. Such a problem is mentioned in a floating platform of U.S. Pat. No. 3,949,693 issued in 1976 to P. Bauer, et al. A floating platform has a polygonal, submerged floating body constructed from concentric pipe sections whereby the space between each two concentric pipes is compartmentized and serves as storage facility as well as ballast tanks. Columns also constructed as upright concentric pipes extend from the submerged float and carry platform defining and establishing frame which carries e.g. a drilling derrick. The interior spaces of all inner pipes serve as transport path, a closed one being provided in the main float and elevator(s) as well as pump-up paths for liquid loads are provided in the columns. About 90%, of the pay load, such as provisions and fuel are to be stored in the inner body. As a consequence, the center of gravity of the structure as a whole is quite low which is very beneficial for the stability of the platform. The regular and symmetrical distribution of loads generally inside of the submerged body enhances stability. On the other hand, the dual transport path inside of the inner pipe that forms a part of the main submerged body permits relocating of loads as well as moving of loads to and from the columns for changing the load distribution as for example, fuel is being used up.

U.S. Pat. No. 5,588,387 issued in 1996 to W. Tellington discloses a floating platform, which is used for a floating airport that includes a plurality of floating modules flexibly coupled to one another. Each module includes at least one buoyant hull removably attached to its underside and capable of vertical and rotational movement to absorb the action of ocean waves. In the preferred embodiment, buoyancy is provided by pairs of pontoons pivotally attached to a walking beam hingedly coupled to the underside of the platform. In addition, each pontoon is equipped with splash trays and scuppers to minimize the impact of waves striking the underside of the module. Each module is separately maneuverable for independent attachment to the floating structure while afloat off-shore. Male/female couplers and tie lines are used that enable a quick and safe connection of each additional module to the floating structure. A system of propulsion jets is provided on all sides of the assembled floating platform to permit the motion of the structure in any desired direction relative to the water. The anchoring of the structure is achieved by continuously monitoring the horizontal position of its center of gravity and by utilizing the propulsion system to avoid any significant movement with respect to a predetermined location.

The floating airport may encounter a problem, associated with change in distribution of load caused by rearrangement of planes or transport. In addition, the effect of the wind is further enhanced by controlling the rotation of the structure so that the axis of rotation is kept in front of its vertical axis (which, by definition, passes through the center of gravity), thus creating a torque with an arm equal to the distance h between the axis of rotation and the center of gravity with a component in the direction required to effect the longitudinal realignment of the airport. It is estimated that a distance h of 250 meters would be optimal for a 5-km long deck structure; that is, the optimal lever arm for the purposes of this invention is estimated to be about 5% of the length of the structure. A range of 0 to 25% may be used under different conditions. For example, the distance h may be changed luring operation as a result of a change in the load distribution on the structure, such as when an unusual number of heavy airplanes is stowed away in a particular area like a maintenance hanger or the like. Thus, the control stability of the floating airport can be further improved by dynamically adapting the distance h to an optimal value for given weight-distribution and weather conditions, as one skilled in the art would be able to determine.

The position-control and anchoring system for the floating airport of the invention is not based on structural ties with stationary monuments, such as massive foundations onshore or offshore or on the bottom of the water body; rather, it is based on the continuous dynamic control of the position of the floating structure while it is free to move on the surface of the water. This freedom of motion makes it possible to always orient the structure longitudinally into the wind, so that the runways are always disposed optimally for landing and take-off irrespective of the wind direction. The stern propulsion system provides the thrust necessary to keep the airfield stationary in the longitudinal direction against the wind, the magnitude of that thrust obviously varying from time to time depending on wind conditions. The position-control system comprises means for sensing the coordinates of the chosen axis of rotation that passes through an imaginary rotation hub with respect to stationary reference points (at least three are required for triangulation purposes) at the bottom of the water body onshore, or on satellites. Such a system could be based on sonar, laser or equivalent technology, as is well known in the art of navigation, and would simply involve telemetry apparatus for generating and/or receiving signals representative of distances from the stationary reference monuments and data processing apparatus for converting the distance information so acquired into a control signal for activating the proper jets to bring the hub to its intended position. Angular deviations from the desired longitudinal attitude (which, in the case of an airport, is always determined by the direction of the prevailing wind) would similarly be measured and appropriate action taken. By continuously monitoring the position of the hub in relation to its intended stationary location and by making adjustments as soon as deviations are measured (both linear and angular), the location and orientation of the airfield can be controlled dynamically and kept substantially fixed, such as if it were rigidly anchored. This feature makes it possible to quickly adjust the orientation of the airstrips to match the wind direction without having to first release the floating structure from a rigid anchoring structure.

U.S. Pat. No. 6,718,901 issued in 2004 to P. Abbott, et al., discloses deploying of an offshore oil and gas production platform by placing a buoyant equipment deck on a buoyant pontoon so that elongated legs on the pontoon, each comprising a buoyant float, extend movably through respective openings in the deck. Chains extending from winches on the deck are reeved through fairleads on the pontoon and connected back to the deck. The chains are tightened to secure the deck to the pontoon for conjoint movement to an offshore location. The chains are loosened and the pontoon and leg floats ballasted so that the pontoon and leg floats sink below the floating deck. The chains are then re-tightened until pawls on the leg floats engage the deck. The buoyancy of at least one of the pontoon and leg floats is increased so that the deck is thereby raised above the surface of the water. The chains are connected to mooring lines around an offshore well site, and the raised deck and submerged pontoon are maintained in a selected position over the site with the winches.

In one exemplary preferred embodiment of the platform, means are provided between the deck and the pawls for distributing the load imposed by the deck on respective ones of the leg floats more uniformly around the circumference thereof when the pawls engage the deck. In the particular embodiment, these means comprise "crush tubes" disposed between the pawls and the deck, which are compressed as the respective pawls assume the weight of the deck during the step of raising the deck above the water. Alternatively, the load distribution means may comprise springs, elastomeric pads, ductile metal blocks, hydraulic rams, or a sandwich of ductile and stiff metals.

U.S. Pat. No. 6,540,441 issue in 2003 to B. Foss, et al. describes a transporter for installation or removal of an offshore platform and a method for removal of an offshore platform. The transporter for removing an offshore platform has an oblong structure with a U-shaped cross section, rotatable by ballasting. The transporter is adapted to remove and carry both a jacket and a topsides simultaneously. The topsides are located offset from the central region of the transporter, creating an uneven load distribution. Therefore, the horizontal position of the transporter is achieved by deballasting ballasting chambers in the projecting portions of the longitudinal pontoons, creating buoyancy that counteracts bouncy in the opposite side of the transporter.

U.S. Pat. No. 5,997,218 issued in 1999 to K. Boerseth describes a method of and apparatus for stabilizing a tension-leg platform in deep water operations. The process consists of stabilizing the buoyancy-support with the float; ballasting the buoyancy-support until the buoyancy-support resides lower in the sea relative to the sea surface; and assembling the platform to the buoyancy-support.

UK Patent 2311319 issued in 1997 to W. Waddell describes a method of assembling an offshore platform of the kind having a generally flat shallow base to rest on a seabed and a relatively slender tower upstanding from that base to support a deck above the water surface. The method consists of installing the base and the tower by moving the base and the tower to the required site and then sinking them to the seabed so that the tower stands generally vertical, floating the deck over the top of the tower, lowering at least three spaced vertical legs individually from the deck to engage the top of the tower, fixing the lower ends of the legs to the top of the tower, and then jacking the deck up on the legs.

The above review shows that there exist a great variety of floating constructions and methods for assembling such constructions that greatly differ from each other depending on their purpose, depth to the sea bottom and overall dimensions. A universal structures and methods applicable to some extent to floating structures of different dimensions and configurations are not known in the art. Also unknown the floating structures of large surface areas that could trace and automatically adjust the mooring lines for raising the altitude of the floating platform in response to the variations in the sea water level. Neither known are floating structures of large surface area that are capable of maintaining a constant position of center of mass irrespective of non-uniform distribution of masses on the surface of the platform during construction of facilities on the surface of the platform. Moreover, the existing structures are assembled from a great variety of specific, non-standard components of different types and dimensions.

SUMMARY OF THE INVENTION

Figure 1:
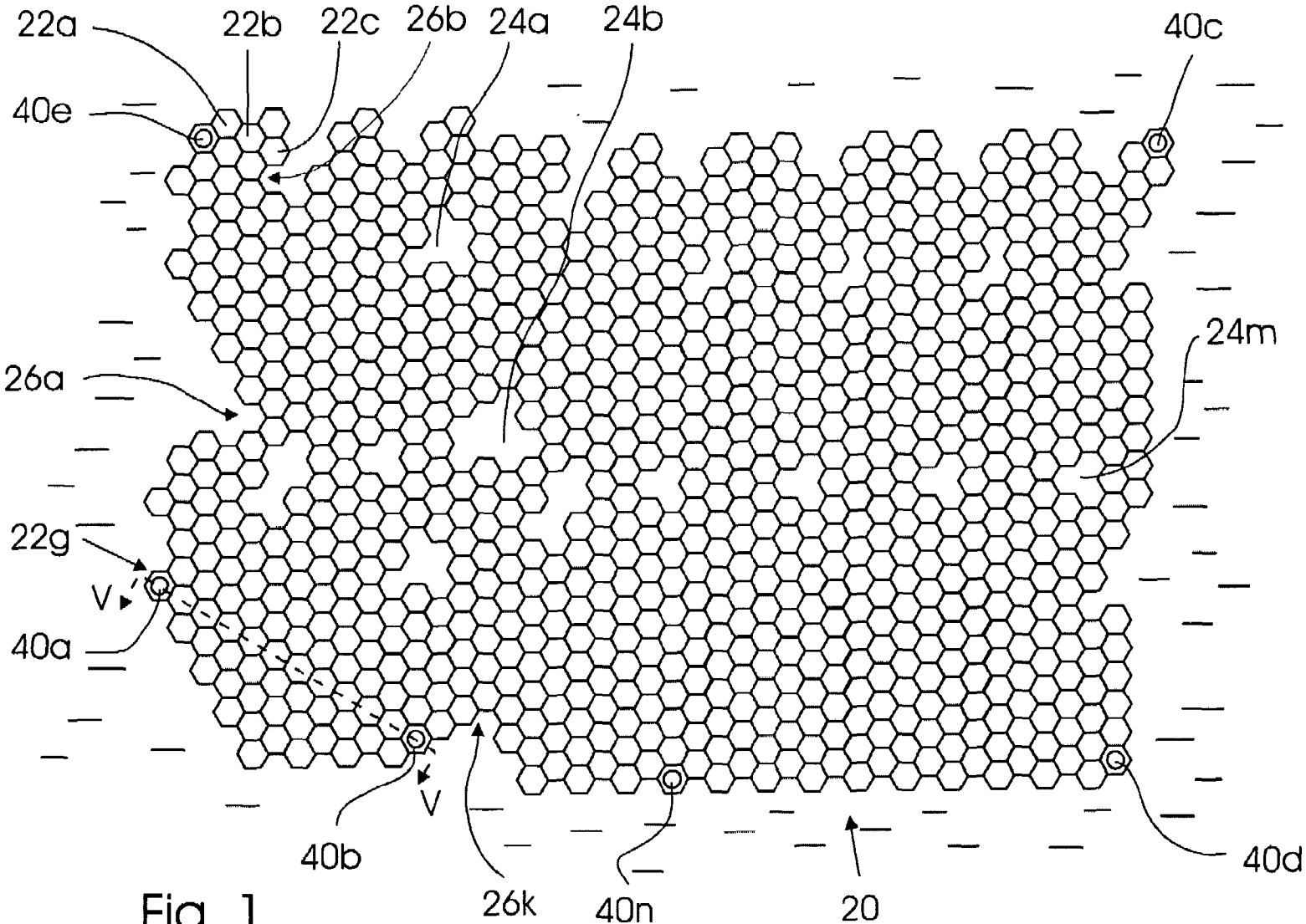
FIG. 1 is a general top view of the floating platform of the invention.

It is an object of the present invention to provide a floating platform that can be assembled from standard hollow prefabricated structural elements having means for adjusting buoyancy. It is another object to provide a floating platform of a large surface area wherein the unified center of masses of the loads supported by the platform always remains in the same position that corresponds to horizontally counterbalanced state of the platform, even during assembling of the platform and construction of on-board facilities. It is still another object to provide a floating platform wherein all the moments created by all the loads supported by the floating platform relative to the aforementioned center of masses are counterbalanced. It is another object to provide a method of assembling a floating platform that is anchored to the sea bottom and can be deployed in shallow as well as in deep waters in such a manner that the unified center of masses of the construction elements and loads supported by the platform remain in the permanent position that maintains the platform in a horizontally counterbalanced state and in such a manner that all moments of the loads supported by the floating platform are in an equilibrium.

The floating platform of the invention comprises essentially a large floating island intended for supporting industrial, commercial, cultural, and dwelling structures that may support a self-contained life for its inhabitants, e.g., places for work, dwelling, and leisure time similar to a small town on the land. The floating platform of the invention is universal in that it is suitable for deployment in shallow as well as in deep waters and in that it is assembled from prefabricated standard structural elements in such a way that during the construction the unified center of masses of the loads that consist of a plurality of arbitrarily distributed components of different masses may always be maintained in the same position. This is achieved by making the aforementioned standardized structural components in the form of hollow elongated elements that possess certain positive buoyancy and has means for adjusting this buoyancy in a wide range. The entire floating platform is assembled from a plurality of such elements that are arranged vertically in a floating state and the upper end faces of which define a continuous flat surface of the platform over the level of the water, while the lower parts thereof are submerged. An arbitrary non-uniform distribution of the load on the surface of the platform may be locally compensated for individual elements or for a local group of elements so that the total center of mass of all on-board loads remain always in the same position relative to the seal level and the platform is always maintained in a substantially horizontal position. The floating platform is either secured to the sea bottom by mooring lines with possibility of adjusting the line lengths in response to the change in the seal level by means of winches installed on the platform, or, in case of shallow waters, is guided on pillars immersed into the seafloor. More specifically, each standardizes structural element comprises a hollow elongated pontoon that can be filled with sea water for submerging or released from water by pumping it out for increasing the buoyancy. When it is necessary to fix the adjusted buoyancy, the empty part of the element can be filled with a light floating material foamed in situ.

DETAILED DESCRIPTION OF THE INVENTION

A general top view of the floating platform of the invention is shown in FIG. 1. It can be seen that in the top view the floating platform that as a whole is designated by reference numeral 20 comprises a mosaic of standardized floating structural elements 22*a*, 22*b*, . . . 22*n* which in a top view and in a transverse cross section have a shape that allow packing of said elements into a monolithic body with the top surfaces of the elements forming a continuous surface. An example of such a shape is a hexagonal cross section. In a top view as well as in a transverse cross-section the standardized floating structural elements 22*a*, 22*b*, . . . 22*n* (hereinafter referred to as structural elements) may have a triangular, square, or another shape, but the hexagonal shape is preferable. The mosaic of the structural elements shown in FIG. 1 is formed by the upper end faces of the structural elements 22*a*, 22*b*, . . . 22*n*, and the elements themselves will be described in detail later. It can be seen from FIG. 1 that end faces of the structural elements form a certain continuous surface area of an arbitrary configuration, which in FIG. 1 is substantially rectangular, but may be in the form of a circle, polygon, or in any other regular or irregular shape. It can also be seen that the continuous area formed by the mosaic of the structural elements 22*a*, 22*b*, . . . 22*n* have openings 24*a*, 24*b*, . . . 24*m* in the inner part of the rectangular configuration of the floating platform and semi-open areas 26*a*, 26*b*, . . . 26*k* formed on the periphery of the floating platform 20. It is understood that the openings and the peripheral areas may be connected by canals (not shown).

Figure 2:
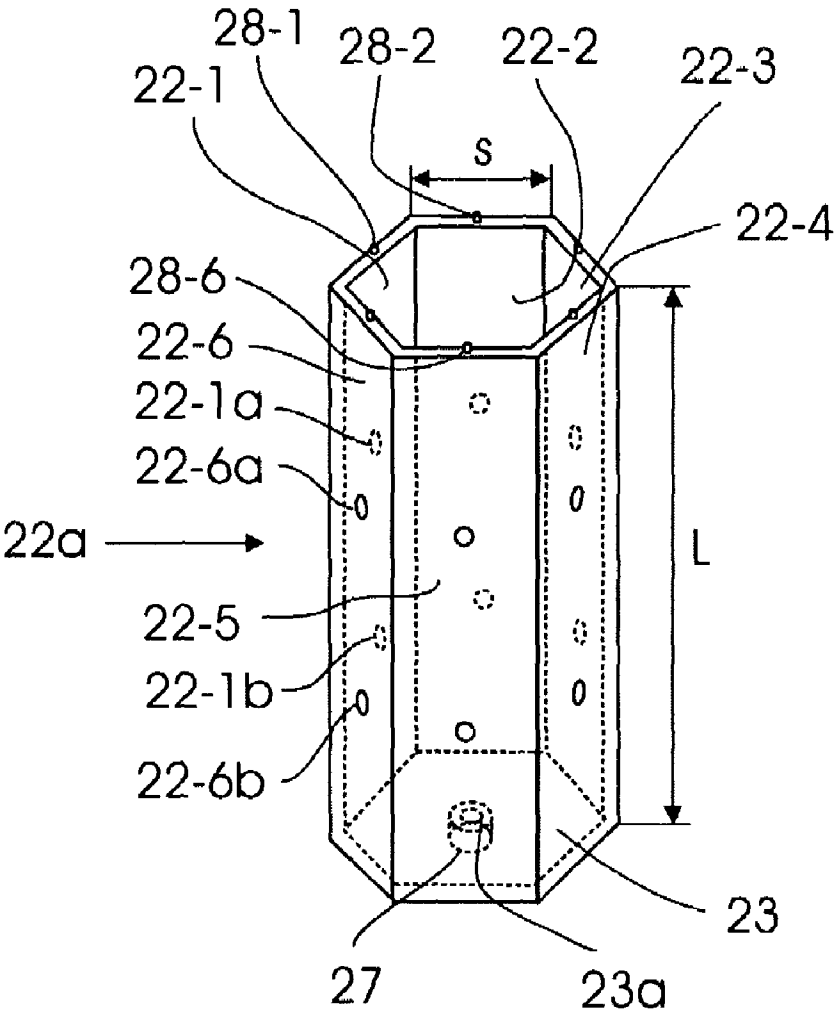
FIG. 2 is a three-dimensional view of the hollow prefabricated standard structural element of the invention.

Since it is assumed that all structural elements are identical (although it can also exist in several types and dimensions), let us consider in detail only one of individual structural elements, e.g., the structural element 22*a*. As shown in FIG. 2, which is a three-dimensional view of the element, the latter comprises a hollow longitudinal three-dimensional body having a cross section in the form of an equilateral hexagon with flat sides 22-1, 22-2, . . . 22-6. The structural element 22*a* has a length L and a side "s". A ratio of "s" to L may vary to optimize the capability of its bouncy adjustment. It can be seen from FIG. 2 that each side 22-1, 22-2 . . . 22-6 has a pair of through openings, i.e., side openings 22-1*a*, 22-1*b* on the side 22-1 . . . 22-6*a*, 22-6*b* on the side 22-6. The upper end of the hollow structural element 22*a* is open, while the lower end is closed by a bottom portion 23 with a through opening 23*a*. Reference numerals 28-1, 28-2, . . . 28-6 designate metal pins that project from the upper end face of the sides that form the element and are intended for insertion into respective openings 30-1, 30-2, . . . , 30-6 formed in a flat hexagonal cover plate 28 shown in FIG. 3 that is placed onto the top end of the structural element 22*a* to form a flat upper surface, so that when the elements 22*a*, 22*b*, . . . 22*n* are assembled into the configuration of the type shown in FIG. 1, the cover plates form a continuous large surface area (except for openings 24*a*, 24*b*, . . . 24*m* and semi-open areas 26*a*, 26*b*, . . . 26*k*).

Figure 4B:
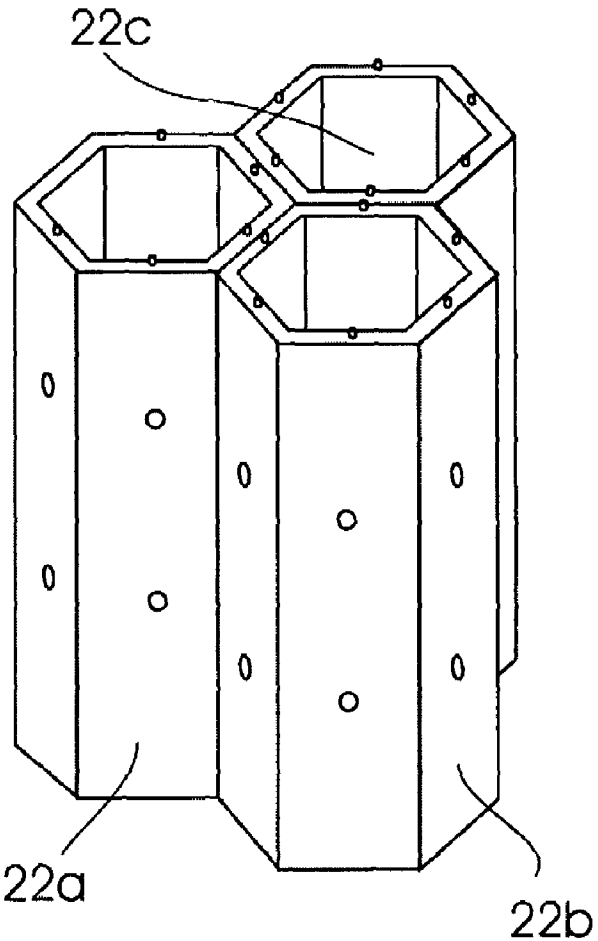
FIG. 4B is a three-dimensional view illustrating a group of interconnected structural elements of the invention.
Figure 4A:
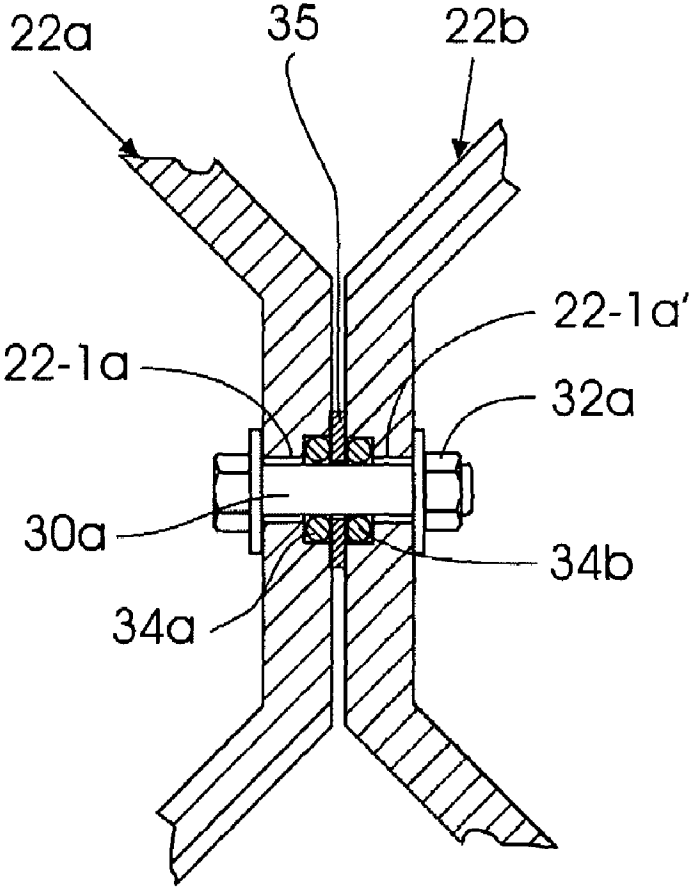
FIG. 4A is a transverse cross section through the point of connection between two mating sides of the adjacent structural elements of the invention.

The aforementioned side openings 22-1*a*, 22-1*b*, . . . 22-6*a*, 22-6*b* (FIG. 2) are intended for assembling the structural elements 22*a*, 22*b*, . . . 22*n* into clusters or into the large body of the floating platform 20 (FIG. 1). An example of a cluster assembled from three such structural elements 22*a*, 22*b*, and 22*c* is shown in FIG. 4*b*. The elements are assembled by connecting the sides 22-1, 22-2 . . . 22-6 of adjacent structural elements. Details of the connection are shown in FIG. 4A which is a transverse cross section through the point of connection between two mating sides of the adjacent elements, e.g., elements 22*a* and 22*b*. For connection, the respective side openings 22*a*-1 and 22*a*-1'2*a*-1' of the adjacent elements 22*a* and 22*b*, respectively, are aligned, and a threaded fastener such as bolt 30*a* is inserted through the hole formed by the side openings 22*a*-1 and 22*a*-1'. The bolt 30*a* is tightened by a nut 32*a*. Reference numerals 34*a* and 34*b* designate resilient O-rings the faces of which are tightly pressed to each other through a washer 35 to seal the interiors of the hollow structural elements 22*a* and 22*b*, when the threaded connection formed by the bolt 30*a* and the nut 32*a* is tightened.

Figure 3:
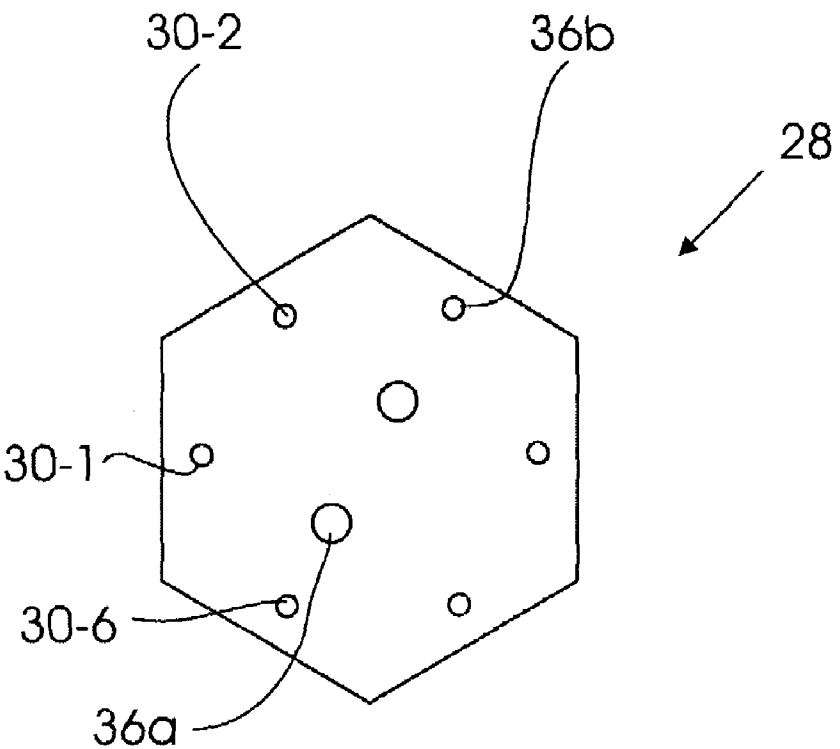
FIG. 3 is top view on a flat hexagonal cover plate that covers the upper end of the hollow standard structural element of the invention.

In the view of FIG. 2, the opening 23*a* in the bottom portion 23 of the structural element is intended for filling the interior of the element with water when the element is submerged into water. This opening 23*a* can be closed by a sealed plug, which is shown conventionally by reference numeral 27 (FIG. 2). In the view of FIG. 3, the openings 36*a* and 36*b* formed in the cover plate 28 are intended for pumping water out from the submerged structural element 22*a* and for filling the interior of the element with a light-weight floating material such as a foam plastic as will be described later. (It is understood that similar openings are provided in cover plates of other elements as well). It is also understood that the structural elements 22*a*, 22*b*, . . . 22*n* may have arbitrary means such eye-bolts or the like for handling the structural elements during transportation and assembling.

Having described the structure of the floating platform 20, let us now consider the method of assembling and managing the floating platform depending on specific conditions.

For assembling the platform 20, the structural elements 22*a*, 22*b*, . . . 22*n* are transported to the place of deployment. This can be done by different methods. For example, the hollow structural elements can be delivered to the place of deployment of the platform on barges in an individual form or in the form of pre-assembled clusters. The clusterized units can be partially filled with water to the extent that the cluster preserves buoyancy and the units can be towed to the place of deployment.

Figure 5:
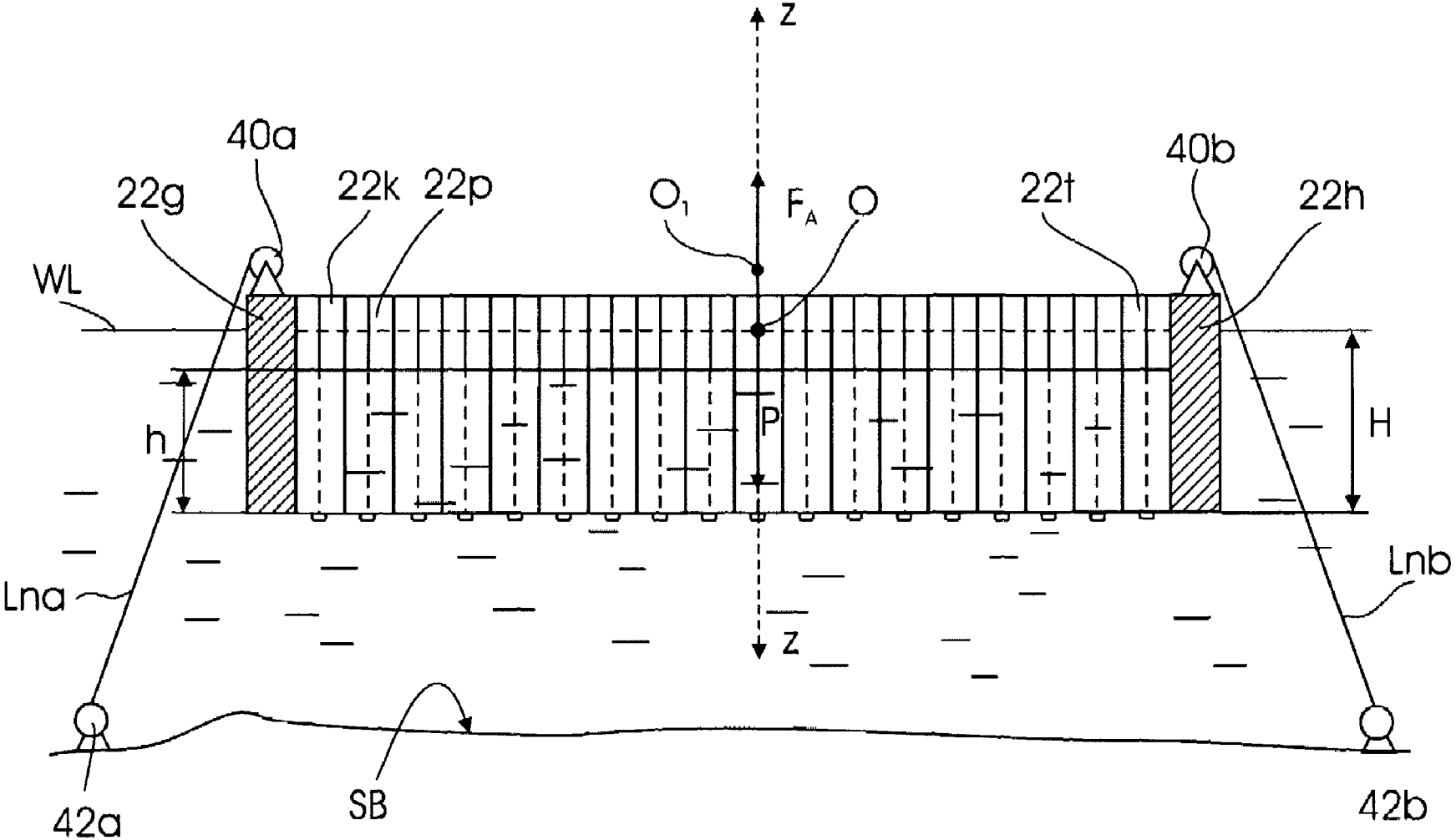
FIG. 5 is a cross-sectional view of the assembled floating platform along line V-V in FIG. 1.

FIG. 5 is a cross-sectional view of the assembled floating platform along line V-V in FIG. 1. The platform 20 is assembled from the aforementioned structural elements, which in FIG. 5 are designated as 22*g*, 22*k*, 22*p*, . . . 22*t*, 22*h*. It is assumed that these elements are assembled in a manner shown in FIGS. 2, 3, and 4. Some of the peripheral structural elements, such as 22*g* and 22*h*, are shown entirely filled with a foam plastic. They are filled after the assembling is completed and can be used for installation of various units of equipment such winches 40*a*, 40*b*, 40*c*, 40*d*, 40*e*, . . . 40*n* shown in FIGS. 1 and 5.

The floating platform 20 is attached to the bottom of the water basin, hereinafter referred to as a seafloor SB, by means of mooring lines such as lines Lna and Lnb shown in FIG. 5. One end of each line is attached to the anchoring device, such as devices 42*a* and 42*b* shown in FIG. 5, while the opposite ends are attached to the respective winches 40*a* and 40*b* with pawls that can tighten or loosen the lines Lna and Lnb in order to always maintain the platform on the surface of the water.

The floating platform 20 is assembled from prefabricated standard structural elements 22*a*, 22*b*, . . . 22*n* in such a way that during assembling of the platform 20 the unified center of mass O (FIG. 5) of the entire platform remains in the same position, and the platform 20 is submerged into water to such an extent that the unified center of mass O is located in the plane that coincides with the water level WL that corresponds to the immersion depth H (FIG. 5). This vertical position (i.e., the rate of buoyancy) of the platform 22 is determined by the level "h" to which all the structural elements are filled with water. The partial filling to the required level "h" is achieved by alternated operations of filling the elements with water through the bottom openings such as the opening 23*a* and pumping the water out from the interior of the elements through the openings such as the opening 36*a* or 36*b* in the cover plate.

After the floating platform 20 is assembled and floats on the surface of the water, the appropriate peripheral elements such as 22*g* and 22*h* are filled with a light floating material, e.g., with a foam plastic and are used for supporting various units of equipment such as winches 40*a*, 40*b*, or embankment equipment, etc. It is recommended to arrange the filled peripheral elements in a uniform manner over the platform periphery so that the unified center of mass $O_1$ of theses elements together with the peripheral equipment supported by them is located on the vertical line Z-Z (FIG. 5) that passes through the unified center O of masses of the platform.

Figure 6:
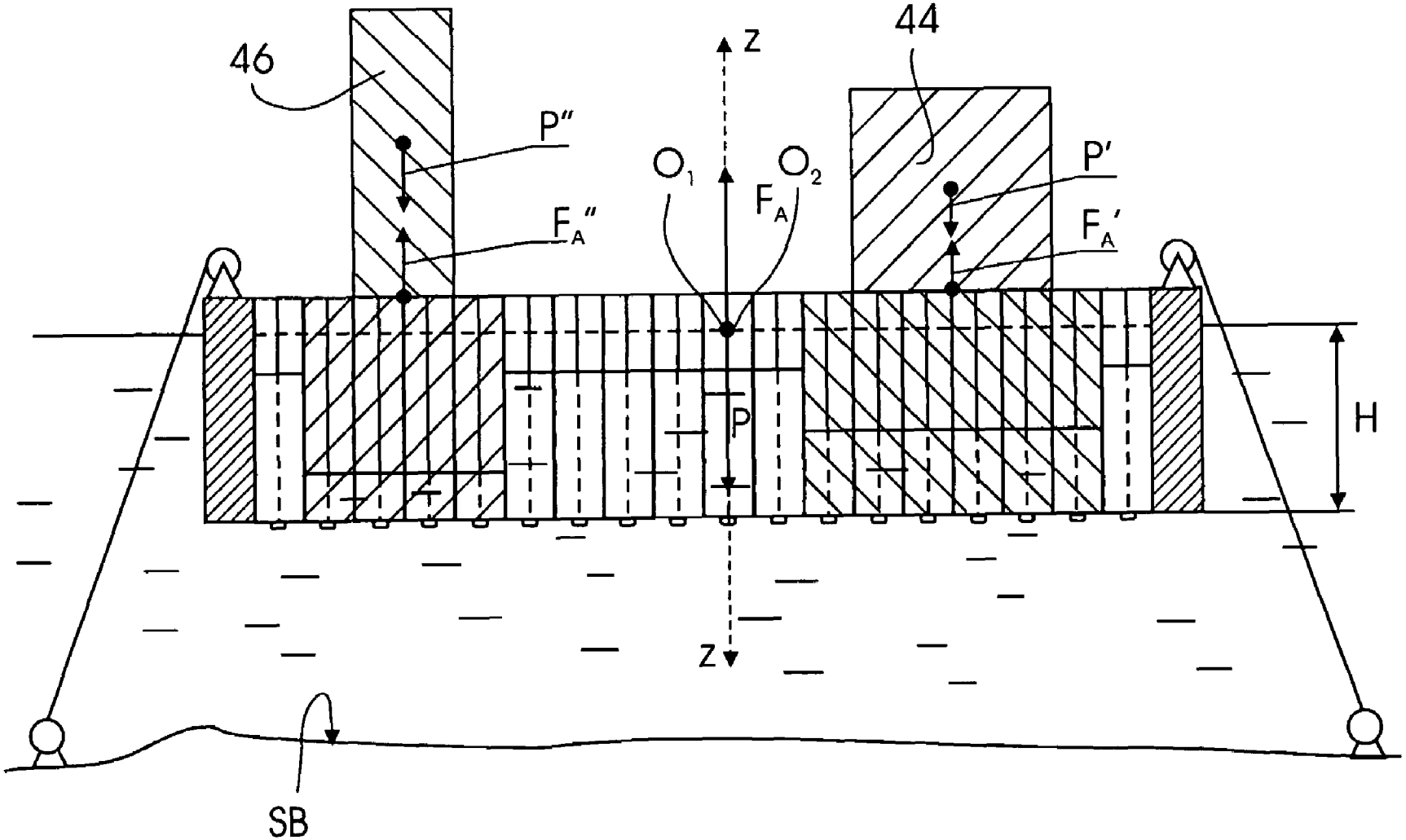
FIG. 6 is a view similar to FIG. 5 illustrating the platform of the invention with non-uniformly distributed load arranged in positions with counterbalanced moments and in a horizontally equilibrium states.

According to the present invention, when non-uniform loads such as loads 44 and 46 shown in FIG. 6 are installed on the platform 22, the buoyancy of the individual structural elements 22*a*, 22*b*, . . . 22*n* or the group of elements such as the group formed by the elements 22*a*, 22*b*, and 22*c* shown in FIG. 4B is locally counterbalanced by adjusting the degree of filling of the elements with water in order to adjust their individual or group buoyancy so that the vertical coordinates of the unified center $O_2$ of masses of loads 44 and 46 together with the mass of the elements themselves remains in the same position. However, this condition is sufficient only for maintaining the floating platform in a substantially horizontal position. This is so-called static stability. In order to provide dynamic stability, it is necessary to counterbalance moments created by the loads relative to the unified center O of masses. This is achieved by arranging the loads so that all loads have equal moments relative to the unified center O of masses. In other words, the moment M1 which is created by the mass P' of the load 44 relative to the center O is equal to the moment M2 created by the mass P" of the load 46 relative to the same center O (FIG. 6). Reference numerals $F'_A$ and $F''_A$ designate respective buoyancy forces of the group of structural elements.

Since the floating platform of a large surface area, such as e.g., one square kilometer or the like possesses an enormous transverse equilibrium, within some practical limits the facilities on the platform may be arranged arbitrarily with violation of the aforementioned counterbalancing of the moments.

If the level of water is raised, the lines Lna and Lnb can be paid out by means of winches such as winches 40*a* and 40*b* (FIG. 5) in order to maintain the platform afloat on the surface of the water.

Figure 7:
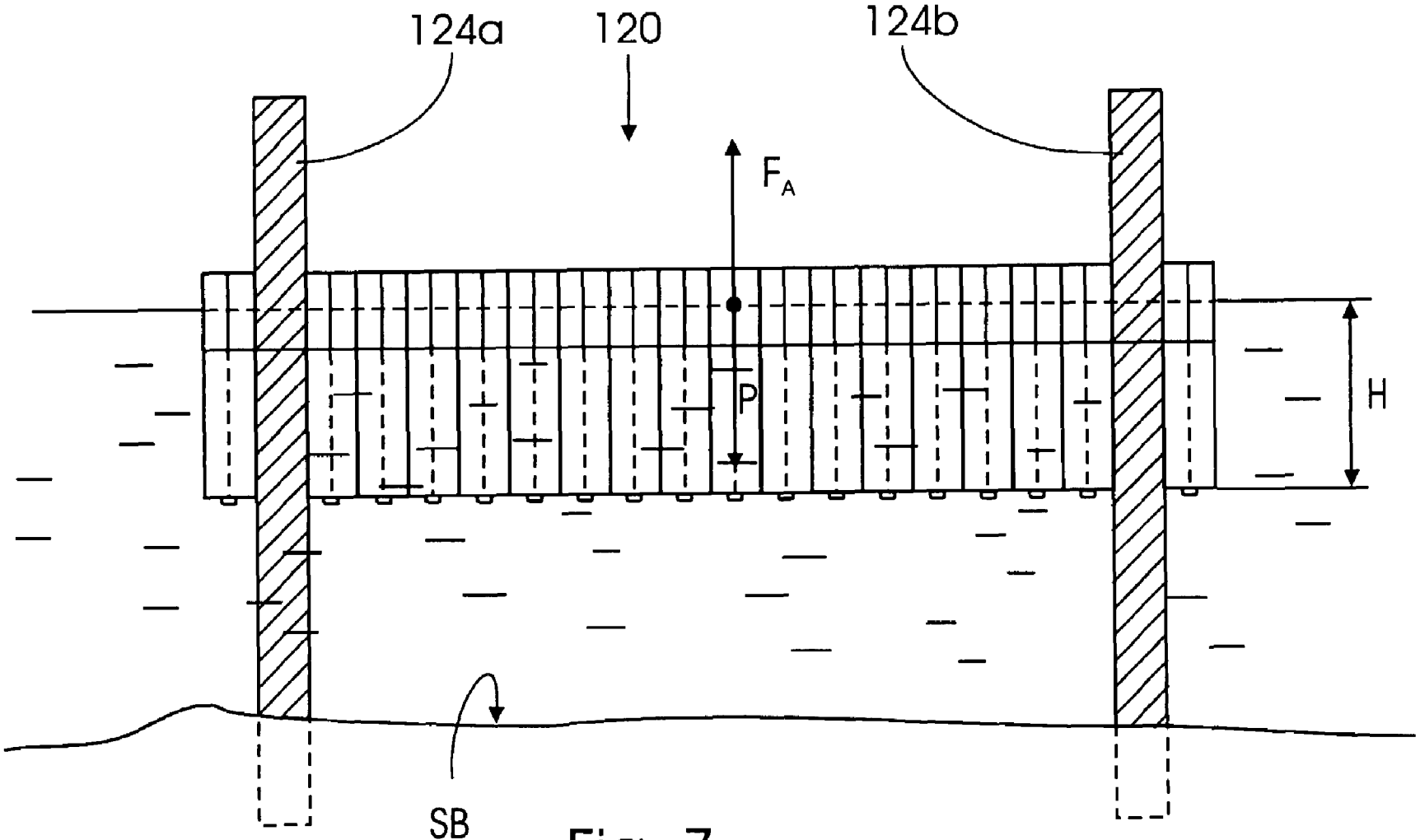
FIG. 7 is a side view on the platform of the invention deployed in shallow waters on vertical guide columns secured to the seafloor.

For deployment of the floating platform, e.g., a platform 120, in shallow waters, the guide columns such as columns 124*a* and 124*b* shown in FIG. 7 that pass through opening such as openings 24*a*, 24*b*, . . . 24*m* (FIG. 1) of appropriate cross section can be used for vertical guiding of the platform.

Thus it has been shown that the invention provides a floating platform that can be assembled from standard hollow prefabricated structural elements having means for adjusting buoyancy. The floating platform covers a large area and have a unified center of masses of the loads supported by the platform always in the same position that corresponds to horizontally counterbalanced state of the platform, even during assembling of the platform and construction of on-board facilities. In the floating platform of the invention all the moments created by all the loads supported by the floating platform relative to the aforementioned center of masses are counterbalanced. The invention also provides a method of assembling a floating platform that is anchored to the sea bottom and can be deployed in shallow as well as in deep waters in such a manner that the unified center of masses of the construction elements and loads supported by the platform remain in a permanent position that maintains the platform in a horizontally counterbalanced state and in such a manner that all moments of the loads supported by the floating platform are in equilibrium.

Although the invention has been described with reference to specific embodiments and drawings, it is understood that the description of these embodiments and the respective drawings were given as examples only and should not be construed as limiting the fields of applications of the invention. Therefore, any changes and modifications with regard to the materials, shapes, structural elements, etc. are possible provided that these changes and modifications do not depart from the scope of the appended claims. In a plan view, for example, the floating platform may have any configuration suitable for its purpose. For example, it may have a round, rectangular, square, or irregular shape. It may have bays on the periphery, holes for access to water from inside the platform territory, canals crossing the platform. The platform may be equipped with sensors that sense the raise of the water level for automatically controlling the winches 40*a*, 40*b* . . . 40*n*. The loads may comprise oil and gas recovery equipment, houses, storages, recreation facilities. The platform may have an elongated shape and comprise an airport and for this purpose may be provided with propulsion means for automatically orienting the platform in the direction of favorable winds. The structural elements may have a square cross-section.

The invention claimed is:

1. A floating platform for deployment on the surface of a water basin in the areas where the bottom of said water basin can be reached for anchoring said floating platform, said floating platform comprising:

a plurality of interconnected floating structural elements, each structural element of said plurality comprising an elongated body with an interior that is hollow or at least partially filled with a material lighter than water, said structural elements floating in a vertically oriented position, each said structural element having means for adjusting buoyancy of said structural element and connecting means for interconnecting each said structural element with an adjacent structural element of said plurality in a sealing engagement for sealing said hollow interior of said structural element from the hollow interior of said adjacent structural element;

said floating platform having means for anchoring said floating platform to said bottom;

said floating platform having a unified center of masses of said plurality of the construction elements that always remains in a position that maintains said floating platform in a horizontally counterbalanced state on the surface of water; all moments created by masses of said structural elements being in equilibrium; wherein each said structural element has side walls, a closed bottom and an open top closed by a cover plate, wherein said means for adjusting buoyancy of said structural element comprise at least one hole in said closed bottom, a plug for closing said at least one hole, and at least one opening in said cover plate for adjusting said buoyancy by pumping out water from said hollow interior of said structural element when said at least one hole in said closed bottom is closed by said plug; and, wherein said connecting means comprise side openings in said side walls with resilient elements on the outer side of said side walls and threaded fasteners inserted through said side openings in said side walls when said side openings in said structural elements are aligned so that in the attached state of said adjacent structural elements said resilient elements are pressed to each other for sealing said hollow interior.

2. The floating platform of claim 1, wherein the surface of said platform comprises a continuous surface formed by a mosaic of said cover plates of said structural elements when said plurality of the structural elements are interconnected by said connecting means.

3. A floating platform for deployment on the surface of a water basin in the areas where the bottom of said water basin can be reached for anchoring said floating platform, said floating platform comprising:

a plurality of interconnected floating structural elements, each structural element of said plurality comprising an elongated body with an interior that is hollow or at least partially filled with a material lighter than water, said structural elements floating in a vertically oriented position, each said structural element having means for adjusting buoyancy of said structural element and connecting means for interconnecting each said structural element with an adjacent structural element of said plurality in a sealing engagement for sealing said hollow interior of said structural element from the hollow interior of said adjacent structural element;

said floating platform having means for anchoring said floating platform to said bottom;

said floating platform having a unified center of masses of said plurality of the construction elements that always remains in a position that maintains said floating platform in a horizontally counterbalanced state on the surface of water; all moments created by masses of said structural elements being in equilibrium; wherein said structural elements are identical prefabricated standardized structural elements, each said structural element having a closed bottom and an open top closed by a cover plate, wherein said means for adjusting buoyancy of said structural element comprise at least one hole in said closed bottom, a plug for closing said at least one opening, and at least one opening in said cover plate for adjusting said buoyancy by pumping out water from said hollow interior of said structural element when said at least one hole in said closed bottom is closed by said plug, or for filling said interior with said material which is lighter than water; and wherein said connecting means comprising side openings in said side walls with resilient elements on the outer side of said side walls and threaded fasteners inserted through said side openings in said side walls when said side openings in said structural elements are aligned so that in the attached state of said adjacent structural elements said resilient elements are pressed to each other for sealing said hollow interior.

4. The floating platform of claim 3, wherein the surface of said platform comprises a continuous surface formed by a mosaic of said cover plates of said structural elements when said plurality of the structural elements are interconnected by said connecting means.

5. A floating platform for deployment on the surface of a water basin in the areas where the bottom of said water basin can be reached for anchoring said floating platform, said floating platform comprising:

a plurality of interconnected floating structural elements, each structural element of said plurality comprising an elongated body with a hollow interior and floating in a vertically oriented position, each said structural element having means for adjusting buoyancy of said structural element and connecting means for interconnecting each said structural element with an adjacent structural element of said plurality in a sealing engagement for sealing said hollow interior of said structural element from the hollow interior of said adjacent structural element;

a plurality of loads of different masses non-uniformly arranged on said floating platform;

said floating platform having means for anchoring said floating platform to said bottom;

said floating platform having a unified center of said different masses that always remains in a position that maintains said floating platform in a horizontally counterbalanced state: all moments created by said different masses of said loads being in equilibrium;

each said structural element having side walls, a closed bottom and an open top closed by a cover plate, wherein said means for adjusting buoyancy of said structural element comprise at least one hole in said closed bottom, a plug for closing said at least one hole, and at least one opening in said cover plate for adjusting said buoyancy by pumping out water from said hollow interior of said structural element when said at least one hole in said closed bottom is closed by said plug; said connecting means comprising side openings in said side walls with resilient elements on the outer side of said side walls and threaded fasteners inserted through said side openings in said side walls when said side openings in said structural elements are aligned so that in attached state of said adjacent structural elements said resilient elements are pressed to each other for sealing said hollow interior.

6. The floating platform of claim 5, wherein the surface of said platform comprises a continuous surface formed by a mosaic of said cover plates of said structural elements when said plurality of the structural elements are interconnected by said connecting means.

7. A floating platform for deployment on the surface of a water basin in the areas where the bottom of said water basin can be reached for anchoring said floating platform, said floating platform comprising:

a plurality of interconnected floating structural elements, each structural element of said plurality comprising an elongated body with a hollow interior and floating in a vertically oriented position, each said structural element having means for adjusting buoyancy of said structural element and connecting means for interconnecting each said structural element with an adjacent structural element of said plurality in a sealing engagement for sealing said hollow interior of said structural element from the hollow interior of said adjacent structural element;

a plurality of loads of different masses non-uniformly arranged on said floating platform;

said floating platform having means for anchoring said floating platform to said bottom;

said floating platform having a unified center of said different masses that always remains in a position that maintains said floating platform in a horizontally counterbalanced state; all moments created by said different masses of said loads being in equilibrium, said structural elements being identical prefabricated standardized structural elements; each said structural element having a closed bottom and an open top closed by a cover plate, wherein said means for adjusting buoyancy of said structural element comprise at least one hole in said closed bottom, a plug for closing said at least one hole, and at least one opening in said cover plate for adjusting said buoyancy by pumping out water from said hollow interior of said structural element when said at least one hole in said closed bottom is closed by said plug; said connecting means comprising side openings in said side walls with resilient elements on the outer side of said side walls and threaded fasteners inserted through said side openings in said side walls when said side openings in said structural elements are aligned so that in attached state of said adjacent structural elements said resilient elements are pressed to each other for sealing said hollow interior.

8. The floating platform of claim 7, wherein the surface of said platform comprises a continuous surface formed by a mosaic of said cover plates of said structural elements when said plurality of the structural elements are interconnected by said connecting means.

* * * * *